US011079124B1

(12) United States Patent
Mathews

(10) Patent No.: US 11,079,124 B1
(45) Date of Patent: Aug. 3, 2021

(54) VERTICAL-AIR WRAPPED-CLOTH SLEEVE EVAPORATIVE WHOLE-HOUSE HUMIDIFIER SYSTEM

(71) Applicant: Raymond D. Mathews, Raleigh, NC (US)

(72) Inventor: Raymond D. Mathews, Raleigh, NC (US)

( * ) Notice: Subject to any disclaimer, the term of this patent is extended or adjusted under 35 U.S.C. 154(b) by 0 days.

(21) Appl. No.: 17/215,302

(22) Filed: Mar. 29, 2021

(51) Int. Cl.
*F24F 6/04* (2006.01)
*F24F 6/00* (2006.01)

(52) U.S. Cl.
CPC ..... *F24F 6/043* (2013.01); *F24F 2006/008* (2013.01)

(58) Field of Classification Search
CPC ..... F24F 6/043; F24F 2006/008
USPC ..... 261/70, 104, 107
See application file for complete search history.

(56) References Cited

U.S. PATENT DOCUMENTS 220,695 A * 10/1879 Bean ..... B01J 19/32 261/102
872,330 A * 12/1907 Cunningham ..... F24F 6/04 261/104
1,367,701 A * 2/1921 Haynes ..... F24F 6/04 261/104
1,668,000 A * 5/1928 Bender ..... F24F 6/04 454/328
1,894,898 A * 1/1933 Trane ..... F24F 6/043 261/104
2,164,763 A * 7/1939 Buck ..... F24F 6/04 261/30
2,494,640 A 1/1950 Abbott
2,839,279 A * 6/1958 Harris et al. ..... F24F 6/043 261/104
3,045,450 A * 7/1962 Chandler ..... F24F 6/043 62/311
4,687,604 A 8/1987 Goettl
4,706,552 A * 11/1987 Maguire ..... F24F 6/043 454/291
7,828,275 B2 * 11/2010 Won ..... F24F 6/043 261/154
8,840,093 B2 * 9/2014 Won ..... F24F 6/043 261/154
8,905,384 B2 * 12/2014 Rodrigs ..... F24F 6/04 261/34.1
9,476,604 B1 10/2016 Mathews

* cited by examiner

*Primary Examiner* — Charles S Bushey
(74) *Attorney, Agent, or Firm* — Dogwood Patent and Trademark Law; Ashley Johnson

(57) ABSTRACT

The presently disclosed subject matter is directed to a whole-house humidifier system including one or more evaporative, unpowered, vertical-air humidifiers. Each humidifier includes a plurality of element sleeves suspended by flat support panels above a built-in water reservoir. The bottom tabs of the reservoir are inserted into the floor register opening for location. The system also includes a cover with windows along a top edge that control the direction of air exiting the system. The position of the cover is controlled by its fit to the outside edges of the water reservoir. A dedicated water supply feeds water through a float valve to control the water level in the reservoir. The element sleeves can easily be cleaned but require no external air duct since air flows up through the center of the humidifier.

20 Claims, 6 Drawing Sheets

VERTICAL-AIR WRAPPED-CLOTH SLEEVE EVAPORATIVE WHOLE-HOUSE HUMIDIFIER SYSTEM

TECHNICAL FIELD

The presently disclosed subject matter is generally directed to a vertical whole-house, evaporative, unpowered humidifier system. Particularly, the disclosed system can be configured as a medical device that provides health protection against viruses (e.g., influenza, Coronavirus, the common cold), coughs, dry skin, sinus troubles, allergies, static electricity, and other problems commonly associated with exposure to dry and/or cold air. The system includes a plurality of water-absorbent element sleeves positioned over holding panels. Warm air blowing from a floor vent contacts the sleeves and absorbs water (e.g., humidity) positioned in the reservoir base before leaving the humidifier. The humidifier includes a float valve to control the water level for maximum element wetted surface area, and the water is supplied by a dedicated water supply. Advantageously, the disclosed system is child-safe with no hazardous electronics, cords, and/or steam to harm users.

BACKGROUND

During the winter months, heating systems are known to dry the air within a home. As a result, the inhabitants can develop a variety of problems, such as dry skin, sore throats, and long-term coughs. In addition, the contents of the home can lose moisture, causing furniture to creak, floors to make noise, and a buildup of static electricity. Proper introduction of indoor humidification can alleviate many of the problems associated with conventional heating systems and provide more comfortable living conditions.

Humidifier systems that utilize moving heated air have been known and used since the early 1960s. These systems are typically positioned near a furnace or as a replacement for a wall or floor register and use the moving air to interact with rigid, wetted plates in contact with a lower water reservoir. The plates are fixed in slots in the reservoir where heated air interacts with the wetted surfaces of the plate to pick up moisture before being expelled into a surrounding room. The prior art systems can include a dedicated water supply so that the user no longer has to constantly fill the humidifier reservoir. However, the dedicated water supply is a sizable extra cost for a total system. Further, unpowered prior art humidifiers are relatively poor at providing humidity regardless of the reservoir size when compared to electrically powered humidifiers, especially the misting and steam humidifiers.

Further, the evaporator plates in prior art systems are usually rigid and are poor water absorbers. Particularly, they are typically constructed from rigid materials, such as cellulose fiber, fiberglass, or other similar materials that slow the wicking process and reduce the amount of water that is delivered to the air. In addition, prior art humidifier systems clog easily, are limited to two external surfaces to interact with air and are generally not able to be cleaned. As a result, the system components must be frequently replaced and rapidly decrease in efficiency. Further, even a slight amount of warping or damage to the evaporative plates render them unusable. Thus, the evaporative plates of prior systems must remain flat and must be held by slots in the reservoir.

It would therefore be beneficial to provide an evaporative humidifier system that overcomes the deficiencies in the prior art.

SUMMARY

In some embodiments, the presently disclosed subject matter is directed to a portable (easily transportable and/or moveable), whole-house humidifier system. The system includes a reservoir defined by a series of interconnected sidewalls and a joined bottom wall with an open top. The reservoir includes an opening positioned in the bottom wall. The opening is surrounded by a series of interior walls that extend into an interior of the reservoir to provide for air flow up to the top. The system includes a cover comprising a series of interconnected sidewalls and a joined top wall sized and shaped to surround the reservoir, creating an interior. The cover is defined by a plurality of window outlets positioned in the top wall and a plurality of panels that extend from one end of the interior to the other within the reservoir. Each panel includes two tails that extend into a bottom portion of the reservoir. The system includes a plurality of flexible and water absorbing sleeves, each sleeve comprising an inner surface and an outer surface and two tails that extend into a bottom portion of the reservoir. Each sleeve is releasably attached to a corresponding panel such that there is space between the inner surfaces of each sleeve and the panel through which air can vertically flow.

In some embodiments, the system further includes a dedicated water supply configured to provide water to the reservoir.

In some embodiments, the panels are flat and sit vertically within the reservoir.

In some embodiments, each sleeve is configured as a flexible single-ply, water-absorbing micro-fiber.

In some embodiments, the sleeve tails are held by the panels such that a bottom edge of the sleeve remains in the lower portion of the reservoir, adjacent to the bottom wall.

In some embodiments, each element sleeve is held vertically by a corresponding panel, such that the inside and outside surfaces of each sleeve is exposed.

In some embodiments, the system further comprises a handle (e.g., a centered handle) positioned on the top wall of the cover.

In some embodiments, the system includes ten sleeves or more.

In some embodiments, the reservoir further comprises a float valve.

In some embodiments, the system comprises an insert tab that cooperates with a floor register opening, providing location for the humidifier.

In some embodiments, the system includes a volume of water positioned within the reservoir, wherein a bottom portion of each tail extends in the water.

In some embodiments, each window includes one or more louvers to direct the flow of air from the system (e.g., into the home and/or surrounding environment). In some embodiments, the louvers are adjustable relative to the top face of the cover.

In some embodiments, the plurality of sleeves are positioned vertically within the interior of the system.

In some embodiments, each sleeve is configured as a flexible single-ply, water-absorbing micro-fiber.

In some embodiments, the reservoir is watertight.

In some embodiments, each sleeve is attached to itself with a butt-stitch.

In some embodiments, the system includes a pair of skids positioned adjacent to a bottom face of the system.

In some embodiments, each tail is attached to a skid.

In some embodiments, each panel includes a support rod.

In some embodiments, each support rod has a length that is about equal to twice the width of each panel.

In some embodiments, each sleeve is configured absorb water at a level of at least about 20, 30, 40, or 50 weight percent relative to the weight of the sleeve.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

Figure 1:
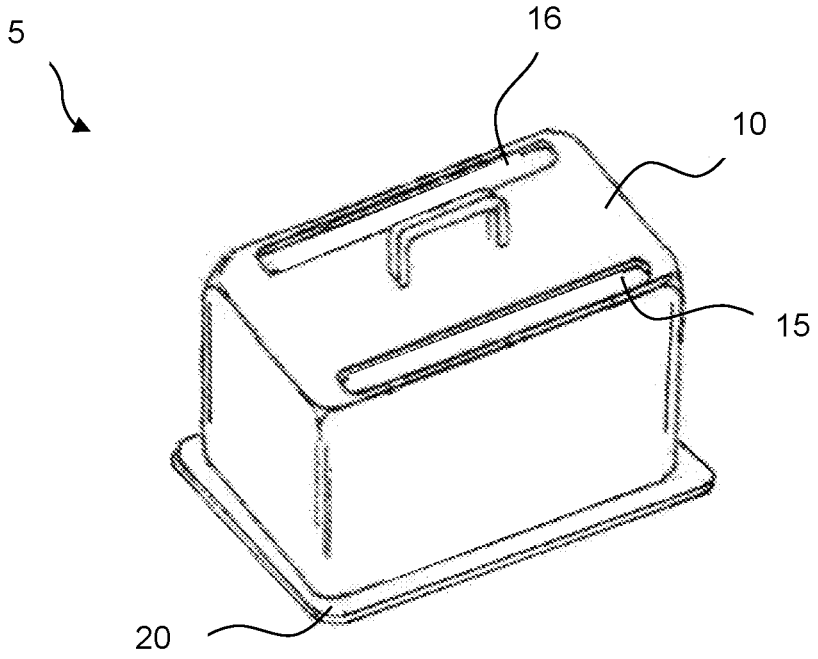
FIG. 1 is a perspective view of a vertical evaporative humidifier system in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−0.1-20% from the specified amount, as such variations are appropriate in the disclosed packages and methods.

The presently disclosed subject matter can be implemented in several different forms. However, the present disclosure of such embodiments is to be considered an example of the principles and are not intended to limit the invention to the specific embodiments shown and described. Like reference numerals are used to describe the same, similar, or corresponding part in the several views of the drawings. The detailed description defines terms used herein and specifically describes embodiments for those skilled in the art to practice the presently disclosed subject matter.

The presently disclosed subject matter is generally directed to a vertical-air wrapped-cloth whole-house evaporative humidifier system. The term "whole-house" refers to the characteristic of being used at any location within a house and/or the ability to effectively provide humified air throughout an entire house. The term "evaporative" refers to relating to or involving evaporation. As illustrated in FIG. 1, system 5 includes outer cover 10 that surrounds the interior system components. The outer cover includes first and second windows 15, 16 through which exiting air is directed from air vent register 20.

Figure 2A:
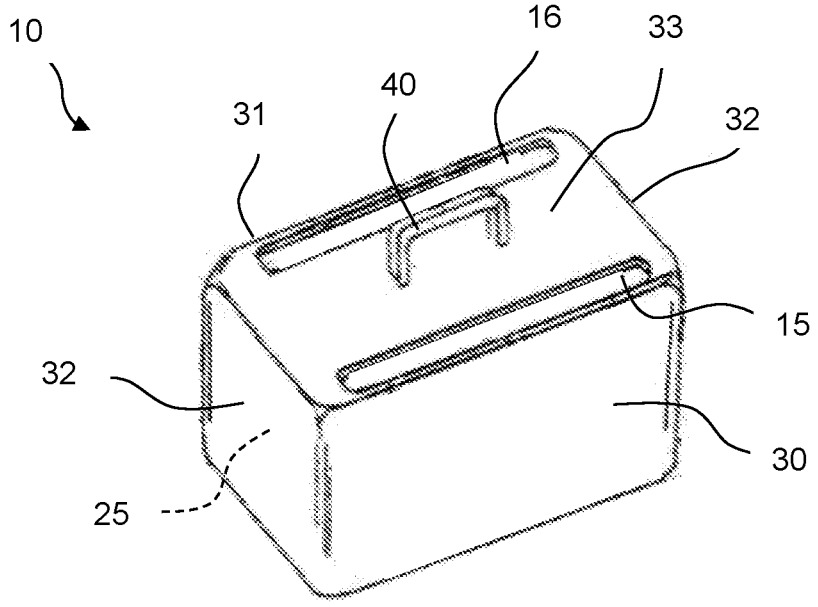
FIG. 2*a* is a perspective view of a vertical evaporative humidifier system cover in accordance with some embodiments of the presently disclosed subject matter.

As noted above, the disclosed system includes outer cover 10 that surrounds all or a portion of the system components. The term "cover" as used herein refers broadly to any device that fits over all or a portion of the remaining system components as defined herein. FIG. 2*a* illustrates one embodiment of cover 10 comprising a series of sidewalls that join together to create interior 25. Particularly, the cover includes front face 30, opposed rear face 31, and a pair of adjoining side faces 32. The top edge of each of the front, rear, and side faces join with top face 33 to create an open bottom and interior 25.

The cover includes one or more windows 15, 16 that allow air to flow out the top of the cover. Each window can have any desired shape and size. For example, in some embodiments, each window can have a length of about 9 inches (e.g., 5-15 inches) and a height of about 3.5 inches (e.g., 2-5 inches). The term "window" refers to any opening through which air can flow. Further, the device can include any number of windows (e.g., 1-10 or more).

Figure 2B:
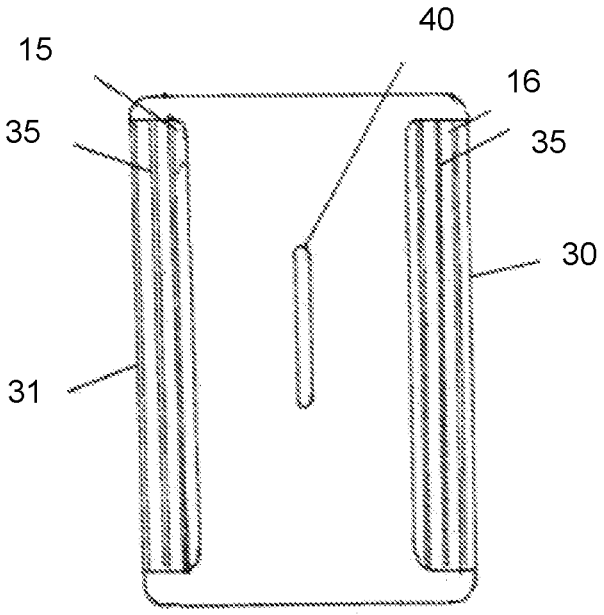
FIG. 2*b* is a top plan view of a vertical humidifier system cover in accordance with some embodiments of the presently disclosed subject matter.
Figure 2C:
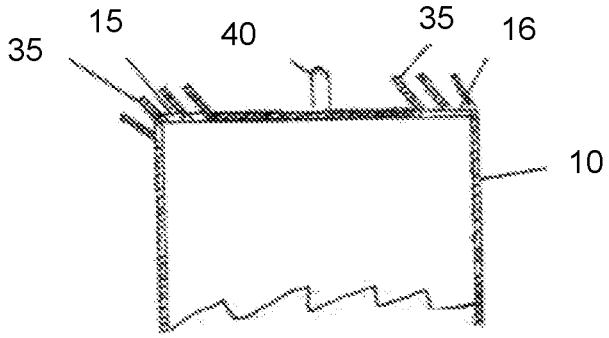
FIG. 2*c* is a fragmentary cross-sectional view of a vertical humidifier system cover showing the adjustable louvers in accordance with some embodiments of the presently disclosed subject matter.

In some embodiments, cover 10 can include one or more directional louvers 35 positioned adjacent to each window, as shown in FIGS. 2*b* and 2*c*. The term "louver" includes any type of adjustable louvers. Cover 30 can include any number of louvers, such as about 1-10 per window. Louvers 35 aid in directing the air exiting the system into a home space. The directional louvers can be set in position (e.g., facing away from the cover) or can be adjusted by the user. For example, the louvers are capable of being positioned at any desired angle relative to the top face of the cover (e.g., 30, 45, 60, 90, 120, 150, or 180 degrees). Louvres 35 provide direction to the upward moving air so that it is controlled in its internal path around the element sleeves, and also out the exit into a room, as described in more detail below.

The cover includes an open bottom that allows a user to access the interior system components (e.g., to remove and wash the sleeves). Cover 10 can be joined with and removed from the internal system reservoir using a centrally-located handle 40, as shown in FIGS. 2*a*-2*c*.

The cover can be maintained in place over the reservoir using its own weight.

Although configured in a rectangular shape in the Figures, it should be appreciated that cover 10 can have any desired shape or size to contain the system interior components.

Figure 2D:
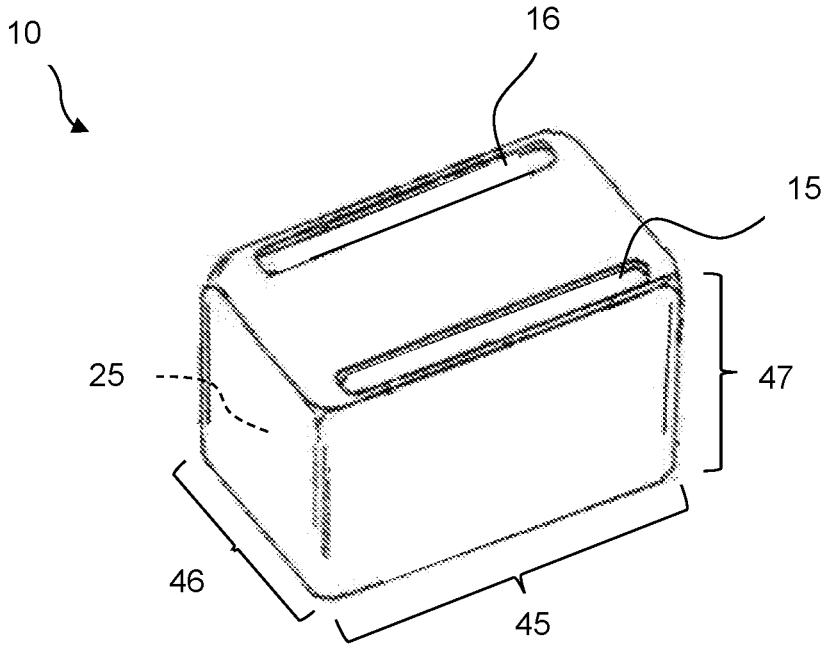
FIG. 2*d* is a perspective view of a vertical evaporative humidifier system cover in accordance with some embodiments of the presently disclosed subject matter.

The cover can have any suitable dimensions. For example, the cover can have width 45 of about 10-12 inches, front-to-rear depth 46 of about 8-10 inches, and height 47 of about 5-6 inches, as shown in FIG. 2*d*. The term "width" refers to the longest horizontal distance of cover 10. The term "depth" refers to the longest horizontal distance between the front face and rear face of the cover. The term "height" refers to the longest vertical distance of the cover (e.g., between the bottom and top faces of the cover).

Cover 10 can be constructed from any rigid or semi-rigid material. The term "rigid material" refers to a material that can withstand an exerted pressure without bending or breaking. The term "semi-rigid material" refers to a material that can withstand an exerted pressure but can bend in response. Thus, outer cover 10 can be constructed from metal (stainless steel, aluminium, copper, and the like), plastic, ceramics, or combinations thereof.

Figure 3A:
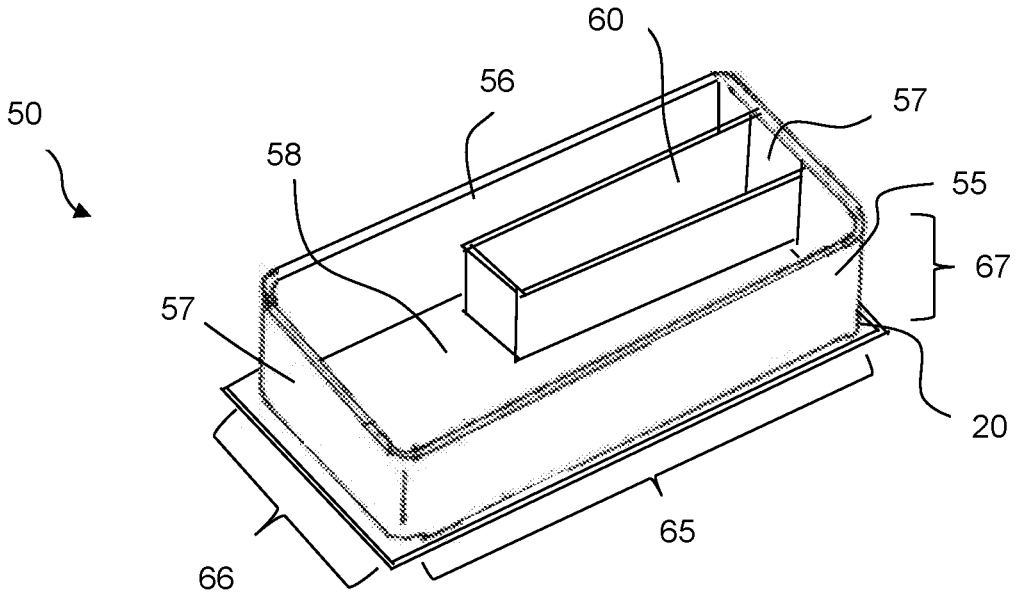
FIG. 3*a* is a perspective view of a vertical humidifier system reservoir in accordance with some embodiments of the presently disclosed subject matter.

The system cover can surround reservoir 50, which locates the cover. One embodiment of reservoir 50 prior to the insertion of the system components is shown in FIG. 3*a*. Particularly, the reservoir includes a series of interior sidewalls 60 that join together to create the system interior. Thus, the exterior of the reservoir includes front face 55, opposed rear face 56, and a pair of adjoining side faces 57. The bottom edge of each of the front, rear, and side faces join with bottom face 58 to create an open top face. The lower portion of the reservoir acts as a water basin during use of system 50. Therefore, the reservoir interior can be configured to be watertight (i.e., capable of holding a small volume of fluid without leaking).

As shown in FIG. 3*a*, the reservoir bottom face 58 includes an opening surrounded by a plurality of walls 60 that create an inlet opening to receive warm air from vent 20. In other words, vent register 20 is flush with the reservoir inlet passage created by walls 60 such that air that exits the vent register travels up into the system interior. Although the air inlet passage will typically mimic the shape of a vent register (rectangular), it can be formed in any desired shape. Walls 60 can be configured with a height less than, equal to, or greater than the height of reservoir 50.

The reservoir can have any suitable dimensions. For example, the reservoir can have length 65 and front-to-rear width 66 to match the length and width of the floor register opening, of about 10-12 inches, and height 67 of about 3-5 inches, as shown in FIG. 3*a*. However, it should be appreciated that the dimensions of the reservoir and cover can be outside the given ranges.

Reservoir 50 can be configured in any desired shape, such as (but not limited to) the rectangular shape such that the reservoir matches the area of the floor register for maximum air flow.

Figure 3B:
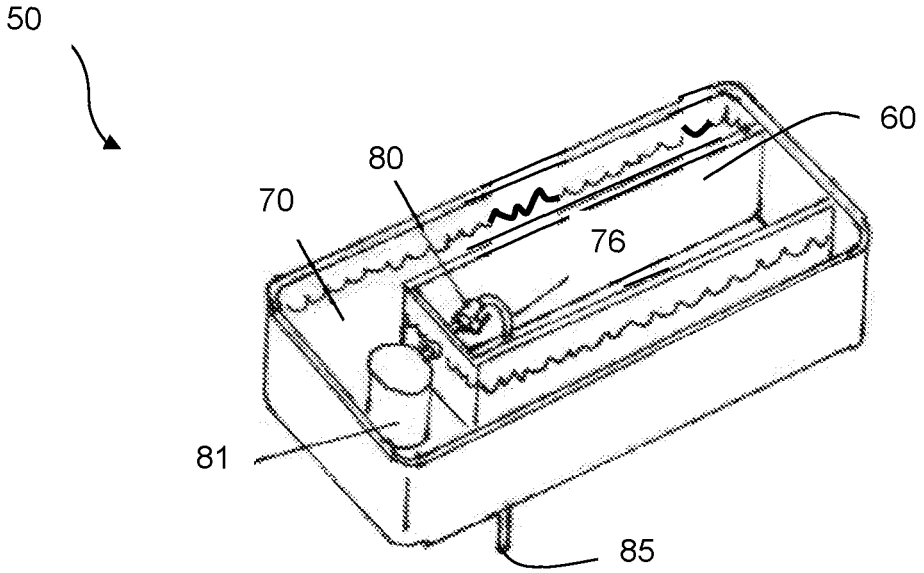
FIG. 3*b* is a perspective view of a vertical humidifier system reservoir comprising water in accordance with some embodiments of the presently disclosed subject matter.

The interior bottom portion of reservoir 50 (other than the inlet passageway) can function as a reservoir, holding a volume of fluid 70 (e.g., water) and a float valve 81, as shown in FIG. 3*b*. The term "float valve" refers to a valve that allows the interior of reservoir 50 to be filled with fluid, while also avoiding overflow and (in the event of low water pressure) backflow. The float valve can be of conventional construction and can include a quick-disconnect valve connected to a hollow sealed float 81 via a lever or ball. The valve is connected to and fed by dedicated incoming water supply line 85 and is opened and closed by the lever or ball in the float valve. In some embodiments, the float valve includes tubing 76 that connects through the container wall to incoming water supply line 85. When the water level rises, the float lever rises with it. Once the float rises to a pre-set level, the float valve forces the lever or ball to close the valve and shut off water flow from supply line 85. The float valve therefore controls the water level in the reservoir low enough to create the maximum wetted surface area of each element sleeve. When the water level rises, the float lever or ball rises with it. The supply line can include a shutoff 80 to allow a user to close off the water supply line manually. The supply line can be operably connected to the closest home water pipe or other water source. It should be noted that there are numerous versions of the float valve (or other valves) suitable for use with the presently disclosed system.

It should be appreciated that the volume of water within reservoir 50 is limited and should not be at a level within the interior of the cover to reach the top of inlet passageway walls 60. In this way, spills are avoided, and water cannot flow into and/or contact the vent register.

The inside portion of the reservoir walls 60 are open such that warm air can blow up through the passageway created by walls 60 and interact with one or more wetted sleeves that are hung within the reservoir interior. The sleeves are wrapped on panels 90. For example, a sleeve can be wrapped on panel 90 such that both tails of the sleeve are in contact with water 70 positioned within the interior of the reservoir. One embodiment of representative panel 90 is shown in the front plan view and top views of FIGS. 4*a* and 4*b*, respectively. The term "panel" includes any element that cooperates with rods 95 to support the weight of one or more sleeves. The sleeves can be joined with a butt-stitch 132, so that the joint can be any place around the panel 90 when inserted. The term "butt-stitch" refers to a stitch where two edges of a single piece of material are joined by first butting the edges together, then stitching. However, any suitable method of joining can be used.

As shown, each panel includes central lower cut-out 100 that straddles the inner wall of reservoir 50. Each cut-out can have a diameter 101 of about 2-6 inches and height 102 of about 2-5 inches. However, it should be appreciated that the dimensions of the cut-out are not limited by size and/or shape. The cut-out creates left and right tails 105, 106 in FIG. 5*a* that are fixedly attached to two skids 134, one under each panel tail to create an assembly of skid-panels that rigidly hold the panels vertical while also spacing the sleeves and panels to include air space between each exterior sleeve surface to the next. This assembly beneficially allows for easy removal of the sleeves, one at a time.

Figure 4A:
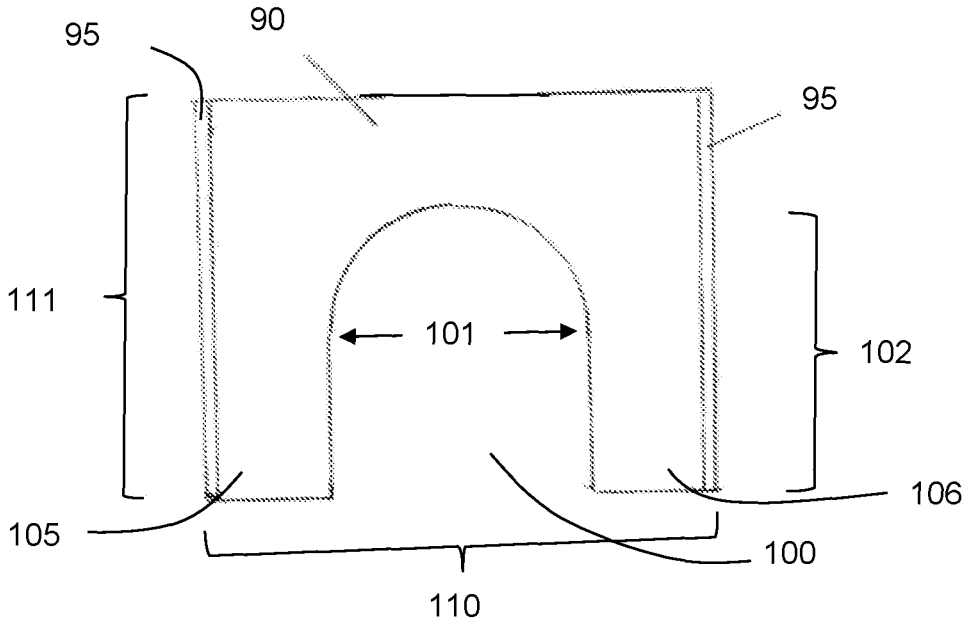
FIG. 4*a* is a front plan view of a sleeve-holding panel in accordance with some embodiments of the presently disclosed subject matter.
Figure 4B:
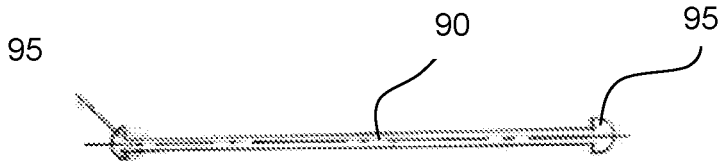
FIG. 4*b* is a top plan view of a sleeve-holding panel in accordance with some embodiments of the presently disclosed subject matter.
Figure 5A:
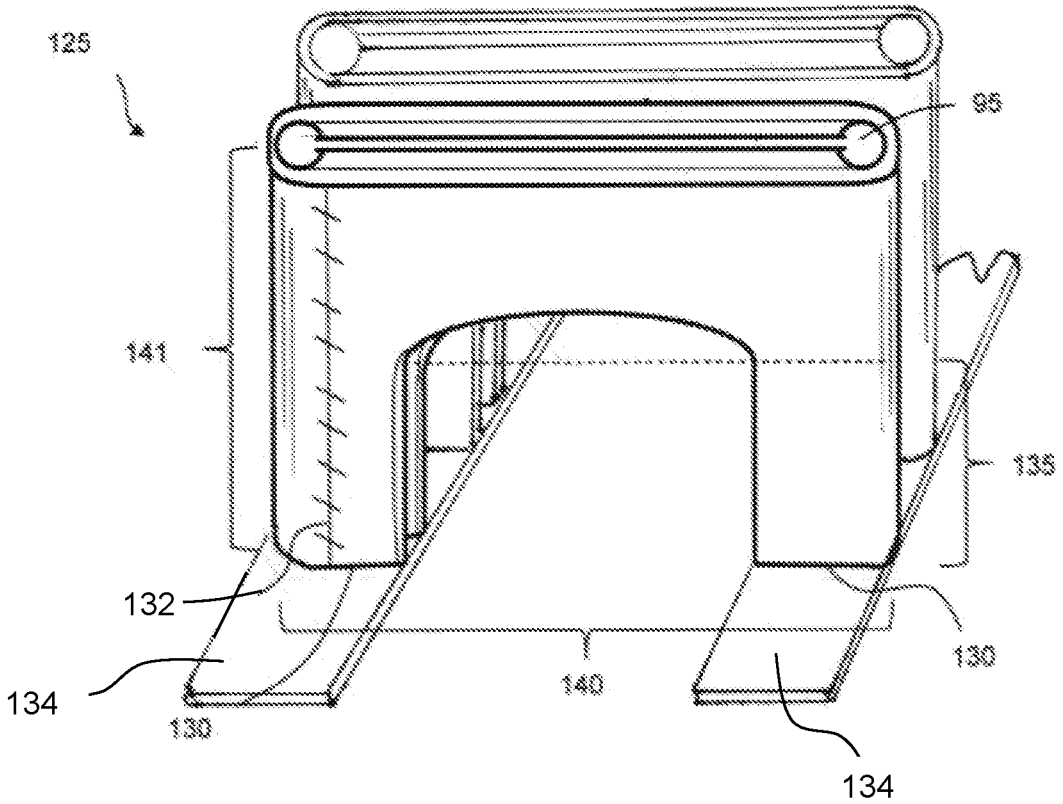
FIG. 5*a* is a perspective view of two element sleeves and lower skids attached under each tail in accordance with some embodiments of the presently disclosed subject matter.

Each end of panel 90 includes rod 95 that holds the sleeves 125 of FIG. 5*a* and creates space for air to move between the panel and inside surface of a corresponding sleeve. The support rod can have any desired cross-sectional shape that allows the rod to separate the inner surfaces of a sleeve. The rods are constructed with a length that is approximately equal to twice the front-to-back width of each panel, as shown in FIG. 4*a*. To this end, each panel can have a full length 110 of about 6-7 inches and height 111 of about 4-6 inches, although any suitable dimensions can be used.

Each rod and/or panel can be constructed from one or more rigid materials (e.g., plastic, metal, ceramic, stone, or combinations thereof).

The panels can be attached to a flat plastic base or skid 134 so that all panel bottoms form an assembly. With this assembly, all wrapped sleeves can be extracted simultaneously from the reservoir.

Each panel 90 is positioned below a corresponding cover window to allow the sleeves suspended from the rods to be in contact with the air flow, as discussed below. In some embodiments, each panel can be positioned about 0.2-0.5 inches below the top of a corresponding window.

System 5 can include any desired number of panels and/or rods. For example, the system can include 8-15 panels or rods (or more in some embodiments), each spanning the front-to-rear width of the reservoir.

The disclosed system also includes a series of sleeves 125 wrapped around panels 90 (e.g., one sleeve per panel). One representative embodiment of sleeve 125 is shown in FIG. 5*a*. Each sleeve includes a pair of open tails 130 with height 135 therebetween. Each sleeve is sized and shaped to fit over at least a portion of a panel. For example, in some embodiments, the sleeve has twice the width 140 when laid flat, height 141 approximately equal to height of panel 90. Although depicted as rectangular in the figures, sleeves 125 can have any desired shape that creates the maximum wetted surface area possible for best humidifier efficiency.

Sleeves 125 can have any desired dimensions. For example, each sleeve can have a full length of about 12-20 inches and height of about 4-5 inches. The term "length" refers to the longest horizontal edge of a sleeve when laid flat on a surface. The term "height" refers to the shortest edge of a sleeve when laid flat. Thus, when wrapped over the support rods, each sleeve can have a height of about 4-5 inches. However, the presently disclosed subject matter is not limited and the size of the sleeves can be adjusted as desired by the manufacturer or user. Each single-ply sleeve can further have a thickness of about 0.1-0.125 inches. It should be appreciated that each sleeve 125 is not limited and can have dimensions outside the ranges given herein.

The term "sleeve" broadly refers to any flexible, absorbent fabric with a central opening allowing it to be wrapped around a panel. Suitable materials can include (but are not limited to) cotton, nylon, wool, lace, netting, polyester, LYCRA®, rayon, micro-fiber, silk, lyocell, acrylic, acetate, or combinations thereof. Thus, each sleeve can be constructed from one or more water absorbent materials. The term "water absorbent" refers to a material having a capacity to absorb water. In some embodiments, a water absorbent material is capable of absorbing water at a level of about 50 percent relative to the weight of the material. In some embodiments, each sleeve can absorb about 20-200% of the weight of the sleeve.

In some embodiments, sleeves 125 can be configured as flexible (e.g., capable of being easily twisted or bent) single-ply fiber cloths.

The sleeves can be flexible (e.g., can be twisted, squeezed, inverted, and/or stretched without tearing). The sleeves can be highly water absorbent (e.g., capable of absorbing water at a level of at least about 20, 30, 40, or 50 weight percent relative to the weight of the material). The sleeves are capable of 'wicking' fluid from reservoir 58 quickly by capillary action, where the wetted wrapped cloth surfaces interact with moving warm air to pick up moisture. The term "capillary action" refers to the flow of a liquid through a porous material due to surface interaction forces. In some embodiments, fluid can travel to the top of the sleeve in about 60 seconds, as evidenced by the user feeling moisture at the top of the wrapped cloth.

Sleeves 125 further act as water filters, absorbing water and air impurities. Thus, the sleeves can act as a filtering agent.

Advantageously, sleeves 125 are constructed from resilient materials and can be easily washed by hand or in a conventional washing machine to remove build-up of contaminants. For example, tests have shown that the sleeves can have a life expectancy of at least 5 years.

Figure 5B:
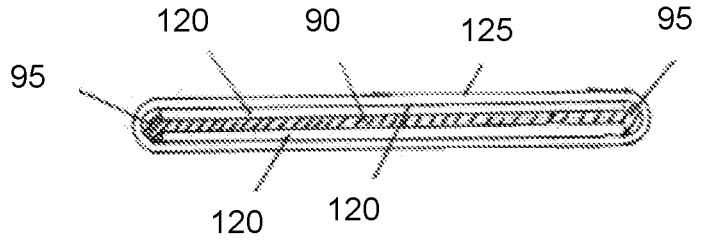
FIG. 5*b* is a top plan view of a holding panel and sleeve in accordance with some embodiments of the presently disclosed subject matter.

FIG. 5*b* illustrates a top plan view of panel 90 with sleeve 125 configured thereon. The figure illustrates the space between the panel and inside surface 120 of sleeve 125. As shown, air is free to flow between the panel and inside surface of the water absorbent sleeve. Particularly, each sleeve includes four wetted surface areas, two wetted outside surfaces and two inside surfaces. By virtue of a sleeve being wrapped-around rod 95, the two inside surfaces of the wrapped cloth are separated by air space and do not touch. As a result, four wetted surface areas per cloth are created above the water surface which interact with air to increase the humidifier efficiency.

A plurality of flexible sleeves can be positioned over the water reservoir, each sleeve supported by a panel such that the outside wetted surfaces of the sleeve and the inside wetted surfaces of the sleeve interact with the moving air that moves up parallel to the axis of the sleeves from the air inlet to the air exit in a vertically upward direction. The sleeves are wrapped over each panel rod and function to wick water from the reservoir to the top portions of the sleeves. The wetted sleeves are therefore in contact with warm air blowing through the air duct, as described in detail below.

Any desired number of sleeves 125 can be used in the disclosed system. For example, in some embodiments about 10 sleeves can be wrapped-around the rods (e.g., about 5-15). However, the system can include any desired number of panels and sleeves.

Figure 6:
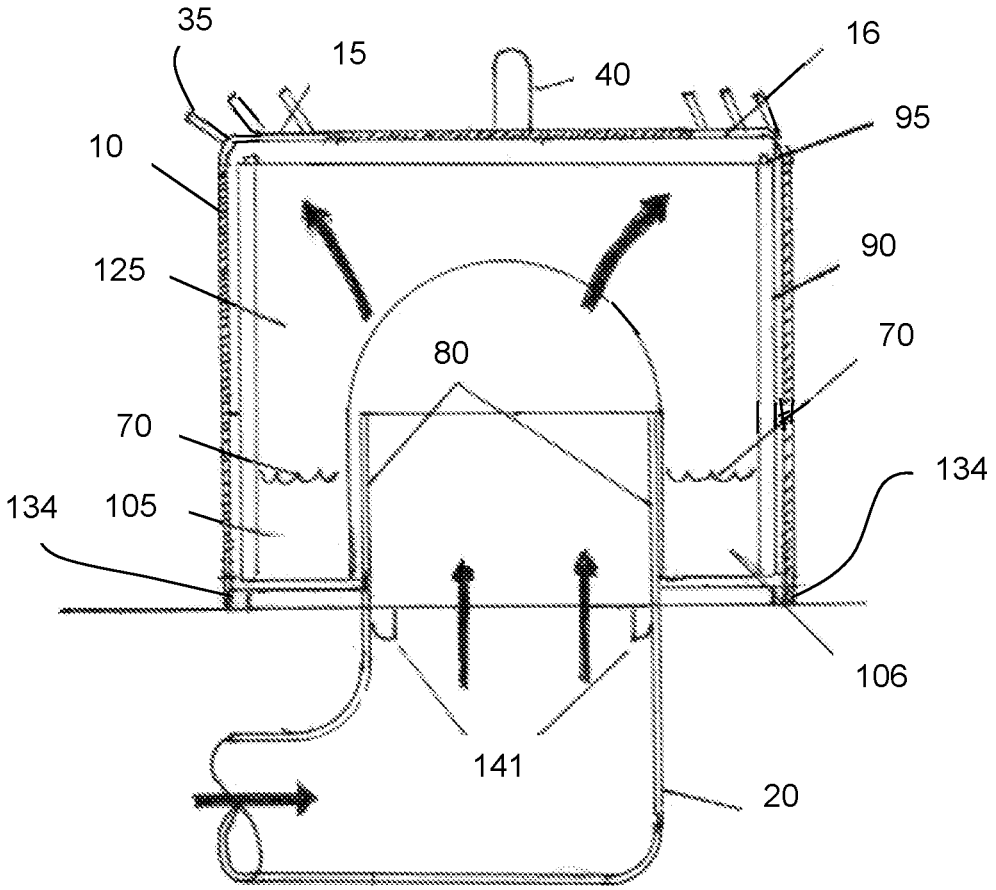
FIG. 6 is a cross-sectional view of a vertical humidifier system in use in accordance with some embodiments of the presently disclosed subject matter.

In use, the disclosed evaporative humidifier system can be easily installed in a home. Particularly, reservoir 50 can be positioned on the floor register 20 such that the passageway inlet created by walls 60 allow air to flow up into the system interior, and the reservoir is located on the floor register by tabs 141. As noted above, cover 10 fits over reservoir 50, as shown in FIG. 6. The cover surrounds the sleeves and helps to control the direction of the upward moving air to the exit windows. Specifically, exterior cover 10 comprising windows 15, 16 fits over and cooperate with the reservoir. Optionally, the windows can include a series of louvers 35 that direct the flow of air as it exits the system. In some embodiments, the cover can include handle 40 to facilitate removal of the cover from the reservoir.

Tails 105, 106 extend into the lower portion of the reservoir, allowing the sleeve to absorb water 70. Heated air flows up vertically through the center of the humidifier reservoir at the inlet passageway created by walls 60, interacting with the wetted surface of a plurality of sleeves 125 to create evaporation, as shown by the arrows in FIG. 6. Specifically, the heated air flows between the spaces between each sleeve, flowing through and contacting the inner surfaces of the sleeves which have been moistened with water 70. The heated and moistened air is then directed out of the system through windows 15, 16. Thus, the air flow moves up through the inner wall of the reservoir where the air is then directed diagonally towards the outside walls of the cover, toward the exit windows.

As a result, the air increases humidity in the surrounding room. In addition, wetted sleeves 125 also filter unwanted impurities such as calcium, iron oxide, and the like from incoming water and air. This is especially advantageous to users that are sensitive to impurities, families with children, or users with allergies. Thus, sleeves 125 can be effectively used for several years with cleaning but without replacement.

As humidified air exits system 5 (e.g., through windows 15, 16), it mixes with the room air to raise the humidity to a range of 40 to 45% relative humidity. For example, the average relative humidity observed with two humidifiers was about 40% in an 1800 square foot home for five winters. It is noted that the high humidity air acts as a preventative against air-borne viruses (e.g., Influenza, colds, and Coronavirus). All humidified air moves through the cold-air return which circulates the warm humid air throughout the home, making these two humidifiers a complete whole house system.

Systems that include additional sleeves increase the humidity such that a single humidifier can produce all of the humidity necessary to create a healthy environment with at least 40% relative humidity. The term "relative humidity" refers to the amount of water vapor present in air expressed as a percentage of the amount needed for saturation at the same temperature.

Since system 5 requires no electricity, warm air movement is controlled by the home thermostat and furnace. As a result, the system is self-regulated and there is no danger of increasing humidity enough to cause the usual problems (such as condensation on windows, mold, and damage to wood and furniture). Also, if humidity gets higher than 40% relative humidity, one or more sleeves 125 can be extracted to lower the humidity slightly and/or the floor register vents can be adjusted to decrease the air flow to the humidifiers.

For example, the key to increased evaporative efficiency depends on the wetted surface area of the sleeves for interaction with air moving past the cloths. The increased evaporative efficiency is accomplished in at least three different ways. First, the wrap-around sleeve design where the rods separate the inner two surfaces of the sleeves, thereby doubling the wetted surface area of each sleeve. Second, a plurality of wrap-around sleeves are used in the interior of the system. Third, the system provides the user with a dedicated water supply and float valve to enable the water level present within the bottom of the reservoir to be lowered (e.g., to about 1 inch) to create the maximum wetted surface area in each sleeve.

Advantageously, the disclosed system requires no seasonal maintenance and no replacement of sleeves 125. It is estimated that system 5 can run smoothly and effectively for at least 5 years without outside maintenance. Accordingly, the user saves at least $115/year since there is no duct cleaning to be done (because there is no heavy moisture in the system up until the time the warm air enters the humidifier).

The vertical-air humidifier can be used in a whole house system. As such, a dedicated water source can be supplied and can be tapped off of the closest home water pipe to the floor register selected by the user, to provide for a compact total whole house system.

Over time, calcium and iron oxide build-up and the introduction of other impurities can build up on the sleeves with extremely hard water. However, the impurities have no known effect on the evaporative efficiency of the sleeves, as verified by hygrometer readings. However, the user may desire to clean the sleeves from time to time. During cleaning, the wrap-around sleeves can be removed from the support panel assembly, placed in a washing machine, and the sleeves can be cleaned with detergent, replaced on the rods (even while still wet), and reinstalled in the humidifier.

The disclosed evaporative humidifier system offers many advantages over prior art humidifier systems. Particularly, the disclosed humidifier has been prototype-tested for over 5 years. In this time, both habitants of the home had fewer colds, coughs, and Influenza infections compared to the time prior to installation of system 5. In addition, less dry skin and other dry-air problems were observed.

Advantageously, system 5 does not require electricity to work. Specifically, there are no electronics used in the system (e.g., no cords, wires, or other electrical connections). Rather, the home thermostat and furnace control the system and the blowing air. Compared to any other humidifier, the user saves money on electrical utilities.

To satisfy a customer, a user can install a single humidifier system at a lower cost, and later determine if a second humidifier system is needed to create the 40% relative humidity suggested for this humidifier.

The disclosed evaporative humidifier system can help save lives. The Center for Disease Control reported that 61,000-79,000 people died of the Influenza virus in 2017-2018. The influenza vaccine is only 36% effective for seniors. As described in detail above, the disclosed system can easily and effectively reduce the number of pathogens in the breathable air of a home (including the Influenza virus). It is therefore believed that the disclosed system can help protect the inhabitants of the home from a variety of maladies, including colds, Influenza, and Coronavirus.

Further, the humid air produced by the disclosed humidifier system allows plants to flourish and retain their freshness, thereby extending their life.

In addition, humidifier system 5 produces warm and humid air, as described above. As a result, users can save on energy costs because they are more comfortable and allow the thermostats to be lowered. The disclosed system utilizes the furnace and thermostat power and therefore does not require electricity. In comparison, most conventional humidifiers are electrically powered, including ongoing electricity costs, cords, and wall plugs. With electrical automatic shutoffs when out of water, unaware users may allow the humidifier to remain without water for hours, eliminating the humidity necessary for good health.

As described above, the disclosed system can include a dedicated water line. As a result, users are not required to constantly refill the water in the system reservoir; this means that interaction between the user and the system is minimized.

Because the sleeves act as impurity filters, the contaminants and other impurities in the air are filtered out before the air enters a user's home. Further, yearly maintenance and/or replacement is not required as with current prior art systems.

System 5 is also cost effective to the user. For example, under-the-house and/or above-floor humidifier maintenance costs are eliminated by the disclosed system. As a result, the user saves money on a yearly basis due at least in part to the unique water absorbing sleeves, as well as the lack of electronics required, meaning that the whole-house humidity system will pay for itself in about two years.

Most existing water-absorbing elements are fragile and difficult to clean. Thus, replacement of the water-absorbing elements in most conventional humidifiers is a requirement. However, the disclosed absorbent sleeves are sturdy, flexible, can be twisted, squeezed, stretched, inverted, and can be stepped on with no damage. Sleeves 125 can also be easily cleaned by hand or in a washing machine.

System 5 effectively extracts impurities from incoming water and air but requires no maintenance or parts replacement for at least 5 years. In comparison, conventional evaporative humidifiers require service and replacement of water-absorbing elements at least yearly due to impurities. Further, the cost of repairing a prior art system can range from about $75 to about $500, depending on the complexity of the system. When a portable humidifier needs repairs, it is cheaper to replace the humidifier than to incur the costs of repairs.

Further, the disclosed system is economical compared to prior art systems. Specifically, the retail cost for system 5 which includes the humidifier (at a cost of about $55 including the cover, reservoir, 12 sleeves/panels, float valve, water-pipe parts) and labor for a dedicated water supply (about $100) totals about $155 total retail cost. In comparison, the least-expensive whole-house system on the market (Aprilaire®, available from Research Products Corporation of Madison, Wis.) sells for about $216, in addition to the cost for a dedicated water system (i.e., about $316). Thus, the disclosed humidifier system is the most economical system available.

Also note that the water-absorbing sleeves have a life of about five years, whereas most competing humidifiers must replace their elements at least once per winter season.

Conventional electronically-controlled portable humidifiers are generally noisy, especially units that include three-speed fans. However, the disclosed system has no moving parts and therefore produces no noise, wear, or power costs.

The manufacturing costs of system 5 are low, at least in part due to the lack of electronics required in conventional humidifiers.

System 5 is safe for children, with no exposure to hot surfaces, electrical cords, or plugs.

The disclosed system can use tap water, which is convenient and does not require the user to purchase distilled or purified water or to heat the water as in steam humidifiers.

Certain types of conventional humidifiers (e.g., ultrasonic-mist humidifiers) create a white dust that covers the surrounding area. In comparison, system 5 creates no white dust and is residue free while gathering impurities in the sleeves.

What is claimed is:

1. A portable, evaporative, whole-house humidifier system used on a floor register, the system comprising:

a reservoir defined by:

a series of interconnected sidewalls and a joined bottom wall with an open top;

an opening positioned in the bottom wall; the opening surrounded by a series of interior walls that extend into an interior of the reservoir;

a cover comprising a series of interconnected sidewalls and a joined top wall sized and shaped to surround the reservoir, creating an interior, wherein the cover is defined by:

a plurality of window outlets positioned in the top wall;

a plurality of panels that extend from one end of the interior to the other within the reservoir, wherein each panel includes two tails that extend into a bottom portion of the reservoir;

a plurality of flexible and water absorbing sleeves, each sleeve comprising an inner surface and an outer surface and two tails that extend into a bottom portion of the reservoir;

wherein each sleeve is releasably attached to a corresponding panel such that there is space between the inner surfaces of each sleeve and the panel through which air can vertically flow.

2. The system of claim 1, further comprising a dedicated water supply configured to provide water to the reservoir.

3. The system of claim 1, wherein the panels are flat and sit vertically within the reservoir.

4. The system of claim 1, wherein each sleeve is configured as a flexible single-ply, water-absorbing micro-fiber.

5. The system of claim 1, wherein the sleeve tails are held by the panels such that a bottom edge of the sleeve remains in the lower portion of the reservoir, adjacent to the bottom wall.

6. The system of claim 1, wherein each element sleeve is held vertically by a corresponding panel, such that the inside and outside surfaces of each sleeve are exposed.

7. The system of claim 1, further comprising a handle positioned on the top wall of the cover.

8. The system of claim 1, comprising ten sleeves or more.

9. The system of claim 1, wherein the reservoir further comprises a float valve.

10. The system of claim 1, further comprising an insert tab that cooperates with a floor register opening, providing a location for the humidifier.

11. The system of claim 1, further comprising a volume of water positioned within the reservoir, wherein a bottom portion of each tail extends in the water.

12. The system of claim 1, wherein each window includes one or more louvers to direct the flow of air from the system into the surrounding environment.

13. The system of claim 12, wherein the louvers are adjustable relative to the top face of the cover.

14. The system of claim 1, wherein the reservoir is watertight.

15. The system of claim 1, wherein each sleeve is attached to itself with a butt-stitch.

16. The system of claim 1, further comprising a pair of skids positioned adjacent to a bottom face of the system.

17. The system of claim 16, wherein each tail is attached to a skid.

18. The system of claim 1, wherein each panel includes a support rod.

19. The system of claim 18, wherein each support rod has a length that is about equal to twice the width of each panel.

20. The system of claim 1, wherein each sleeve is configured to absorb water at a level of at least about 20, 30, 40, or 50 weight percent relative to the weight of the sleeve.

* * * * *